US009771911B2

(12) United States Patent
Oohata et al.

(10) Patent No.: US 9,771,911 B2
(45) Date of Patent: Sep. 26, 2017

(54) FUEL INJECTION VALVE

(71) Applicant: DENSO CORPORATION, Kariya, Aichi-pref. (JP)

(72) Inventors: Keigo Oohata, Kariya (JP); Eiji Itoh, Anjo (JP)

(73) Assignee: DENSO CORPORATION, Kariya (JP)

( * ) Notice: Subject to any disclaimer, the term of this patent is extended or adjusted under 35 U.S.C. 154(b) by 108 days.

(21) Appl. No.: 14/458,624

(22) Filed: Aug. 13, 2014

(65) Prior Publication Data

US 2015/0053182 A1 Feb. 26, 2015

(30) Foreign Application Priority Data

Aug. 23, 2013 (JP) ..... 2013-173674

(51) Int. Cl.
*F02M 61/14* (2006.01)

(52) U.S. Cl.
CPC ..... *F02M 61/14* (2013.01); *F02M 2200/858* (2013.01)

(58) Field of Classification Search
CPC ..... F02M 2200/858; F02M 55/004; F02M 2200/16; F02M 2200/26
USPC ..... 123/470; 239/533.2, 584, 585.1
See application file for complete search history.

(56) References Cited

U.S. PATENT DOCUMENTS 5,752,487 A 5/1998 Harrell et al.
6,178,950 B1 1/2001 Stockner et al.
6,575,385 B1 * 6/2003 Stier ..... F02M 51/0603 239/102.2
6,938,901 B2 * 9/2005 Tsuchiya ..... F02M 61/14 277/437
7,918,209 B2 * 4/2011 Fischetti ..... F02M 61/14 123/470

(Continued)

FOREIGN PATENT DOCUMENTS

DE 103 21 163 12/2004
DE 10 2005 019 313 11/2006

(Continued)

OTHER PUBLICATIONS

Japanese Patent Office, "Notification of Reason for Refusal," (3 pages) issued in connection with Japanese Patent Application No. 2013-173674, dated Aug. 18, 2015, with its English language Translation (4 pages).

*Primary Examiner* — Marguerite McMahon
*Assistant Examiner* — James Kim
(74) *Attorney, Agent, or Firm* — Nixon & Vanderhye P.C.

(57) ABSTRACT

A fuel injection valve is attached to an engine and to have an annular seal material attached thereon. The seal material is attached to a first reduced diameter part. In a use state where a body is inserted in an attachment hole formed at a predetermined position of the engine and a gas pressure that is equal to or higher than a predetermined pressure is applied to the seal material from its nozzle hole-side, the seal material is pressed against a first tapered part by the gas pressure to be compressively deformed, and a clearance between an inner peripheral surface of the attachment hole and an outer peripheral surface of the body is sealed with a compressively-deformed part of the seal material. A taper angle of the first tapered part is set in a range from 10 degrees to 20 degrees.

12 Claims, 11 Drawing Sheets

(56) References Cited

U.S. PATENT DOCUMENTS

| | | | | |
|---|---|---|---|---|
| 2002/0179057 | A1* | 12/2002 | Reiter | F02M 51/0671 123/472 |
| 2003/0168534 | A1 | 9/2003 | Hohl | |
| 2007/0228193 | A1* | 10/2007 | Kato | F02M 61/166 239/533.2 |
| 2007/0272114 | A1 | 11/2007 | Tsuchiya et al. | |
| 2008/0245340 | A1* | 10/2008 | Beardmore | F02M 61/14 123/470 |
| 2008/0314365 | A1* | 12/2008 | Daniel | F02M 61/14 123/470 |
| 2011/0303192 | A1* | 12/2011 | Jung | F02M 61/14 123/445 |

FOREIGN PATENT DOCUMENTS

| | | |
|---|---|---|
| EP | 2 080 893 | 7/2009 |
| JP | 2002-285939 | 10/2002 |

* cited by examiner

FUEL INJECTION VALVE

CROSS REFERENCE TO RELATED APPLICATION

This application is based on Japanese Patent Application No. 2013-173674 filed on Aug. 23, 2013, the disclosures of which are incorporated herein by reference.

TECHNICAL FIELD

The present disclosure relates to a fuel injection valve that injects fuel, which is used for combustion in an internal combustion engine.

BACKGROUND

In the case of such a structure that a body of a fuel injection valve is inserted and attached into an attachment hole formed at a predetermined position of an internal combustion engine, there is required a prevention of a leakage of gas in a fuel injection space (e.g., inside a combustion chamber or an intake pipe) through a clearance between an inner peripheral surface of the attachment hole and an outer peripheral surface of the body.

Accordingly, an annular seal material is conventionally disposed in this clearance. Specifically, a radially-recessed reduced diameter part is formed on the outer peripheral surface of the body, and the body is inserted into the attachment hole with the seal material attached to this reduced diameter part (see JP-A-2005-155394).

The inventors have considered forming a tapered part on a part of the outer peripheral surface of the body on an opposite side of the reduced diameter part from a nozzle hole. This tapered part has such a shape that a diameter size of the body increases gradually in a direction further on the opposite side from the nozzle hole. Accordingly, in a use state where gas pressure is applied from the nozzle-hole side of the seal material, when the seal material is pushed up toward the opposite side from the nozzle hole by this gas pressure, the seal material is clamped between the inner peripheral surface of the attachment hole and the tapered part. As a result, a compressive deformation of the seal material in its radial direction is promoted, so that the surface pressure of the seal material increases (this phenomenon is hereinafter referred to as a wedge effect). For this reason, sealing properties by the seal material improve.

As a taper angle of the tapered part becomes smaller, the seal material has a greater wedge effect to increase the effect of the improvement in sealing properties. However, if the taper angle is made excessively small, there is a concern about damage to the seal material as described below.

Specifically, when the fuel injection valve is attached at the predetermined position of the engine by inserting its body into the attachment hole of the engine, the seal material is scraped against the inner peripheral surface of the attachment hole and receives frictional force, so that the seal material may be rubbed up and displaced to the opposite side from the nozzle hole. Although the tapered part operates to limit the displacement of the seal material, the tapered part has less effect of limiting the displacement as the taper angle is made smaller. When the displacement of the seal material becomes excessively large, the above-described surface pressure by the wedge effect unduly rises. If the body further continues to be inserted into the attachment hole in this state, the seal material is torn up and damaged.

In short, there is a trade-off relationship between the improvement of sealing properties by the wedge effect by decreasing the taper angle, and the limitation of the displacement of the seal material by increasing the taper angle.

SUMMARY

The present disclosure addresses at least one of the above issues.

According to the present disclosure, there is provided a fuel injection valve adapted to be attached to an internal combustion engine and to have an annular seal material attached thereon. The fuel injection valve includes a body, a first reduced diameter part, and a first tapered part. The body includes a nozzle hole through which fuel is injected. The first reduced diameter part is formed on an outer peripheral surface of the body to have a shape obtained by radially reducing the body. The seal material is attached to the first reduced diameter part. The first tapered part is formed on the outer peripheral surface of the body on an opposite side of the first reduced diameter part from the nozzle hole. The first tapered part has its diameter size of the body increased gradually toward the opposite side from the nozzle hole. In a use state where the body is inserted in an attachment hole formed at a predetermined position of the engine and a gas pressure that is equal to or higher than a predetermined pressure is applied to the seal material from its nozzle hole-side, the seal material is pressed against the first tapered part by the gas pressure to be compressively-deformed, and a clearance between an inner peripheral surface of the attachment hole and the outer peripheral surface of the body is sealed with a compressively-deformed part of the seal material. A taper angle of the first tapered part is set in a range from 10 degrees to 20 degrees.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
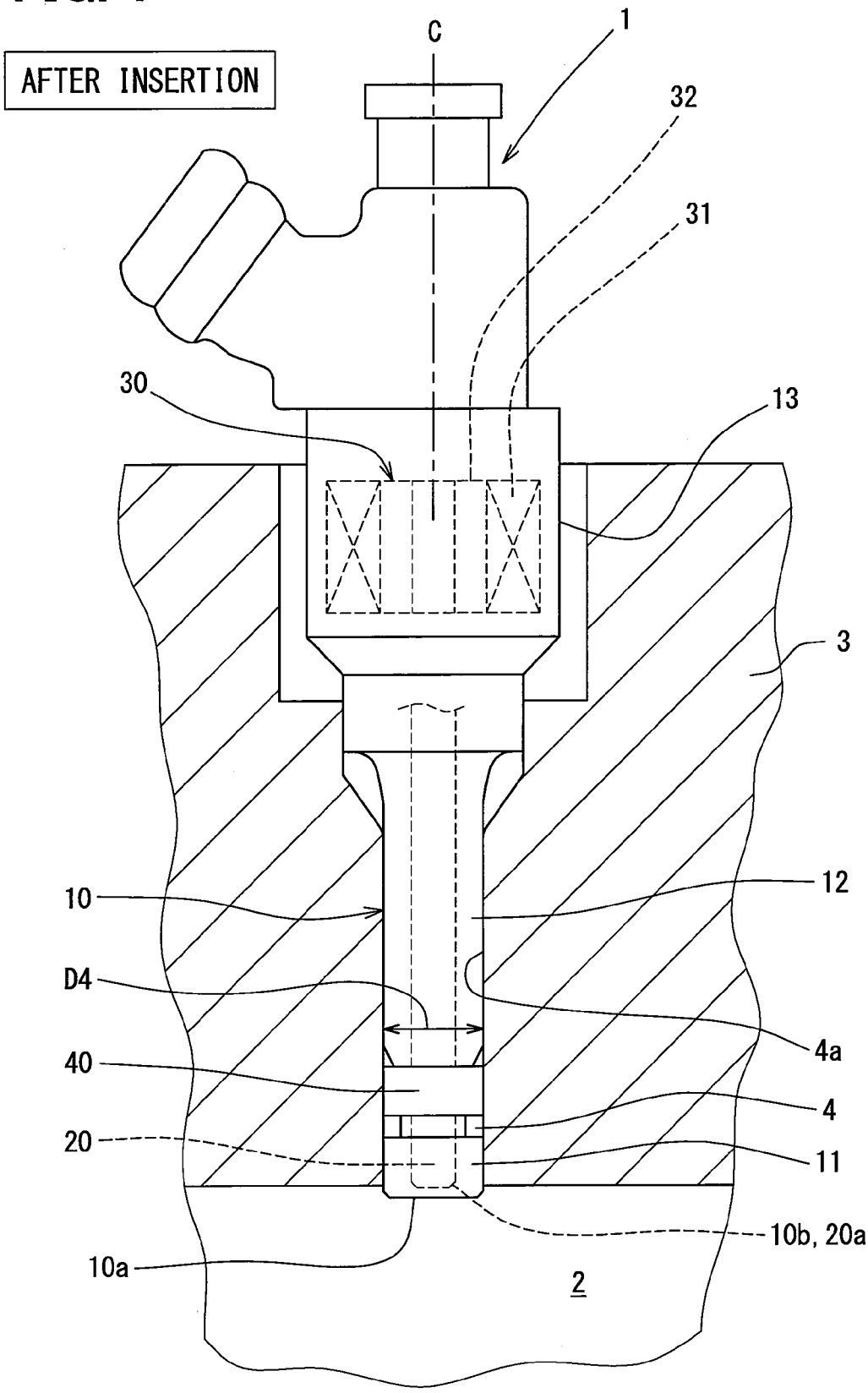
FIG. 1 is a diagram illustrating a state where a fuel injection valve is attached to an internal combustion engine in accordance with a first embodiment.

Embodiments will be described below with reference to the accompanying drawings. In each embodiment, to a part corresponding to the part described in the preceding embodiment, the same reference numeral may be given so as to omit a repeated description. In a case of description of only a part of configuration in each embodiment, a configuration in another embodiment explained ahead of the embodiment can be applied to the other part of the configuration. In the embodiments, in addition to combination between parts which are specifically shown to be combinable, embodiments can be combined partially with each other even if not expressly shown as long as the combination does not particularly create problems.

(First Embodiment)

A fuel injection valve 1 illustrated in FIG. 1 is disposed in an ignition-type internal combustion engine (gasoline engine) to inject fuel directly into a combustion chamber 2 of the engine. Specifically, an attachment hole 4, into which the fuel injection valve 1 is inserted, is formed at a position of a cylinder head 3 which defines the combustion chamber 2, this position corresponding to the central line C of a cylinder.

The fuel injection valve 1 includes therein a fuel passage, and has a body 10 with a nozzle hole 10*a* through which fuel is injected. A valving element 20, an electric actuator 30, and so forth are accommodated in the body 10. The valving element 20 includes a seat surface 20*a* which is engaged with or disengaged from a seat surface 10*b* of the body 10. When the valving element 20 is closed to engage the seat surface 20*a* with the seat surface 10*b*, the fuel injection through the nozzle hole 10*a* is stopped. When the valving element 20 is opened (lifted up) to disengage the seat surface 20*a* from the seat surface 10*b*, fuel is injected through the nozzle hole 10*a*.

The electric actuator 30 is configured to include a solenoid coil 31 and a fixed core 32. Upon energization of the coil 31, the fixed core 32 produces magnetic attraction force. A movable core (not shown) is attracted to the fixed core 32 by this magnetic attraction force, and the valving element 20 is thereby lifted up. The valving element 20 which is joined to the movable core is lifted up (opened) together with the movable core. On the other hand, when the energization of the coil 31 is stopped, the valving element 20 is closed together with the movable core by resilient force of a spring (not shown).

An annular seal material 40 is attached on an outer peripheral surface of the body 10. A clearance located between the outer peripheral surface of the body 10 and an inner peripheral surface 4*a* of the attachment hole 4 is sealed with this seal material 40. Accordingly, the gas in the combustion chamber 2 is prevented from leaking out to the outside through this clearance. A material for the seal material 40 is required to be elastically deformable and to have heat resistance. Fluororesin may be employed for the material for the seal material 40 as an illustrative example.

Figure 2:
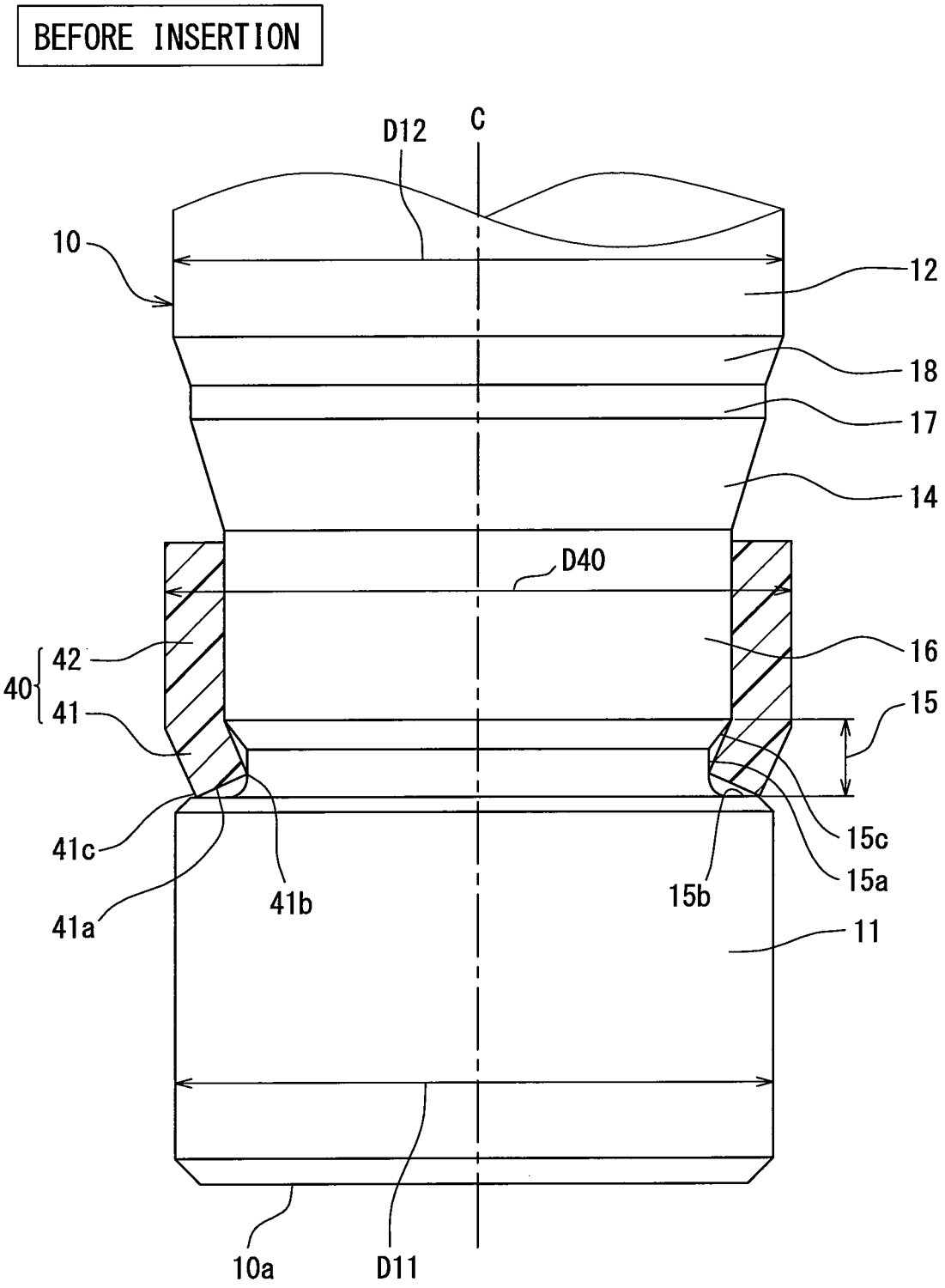
FIG. 2 is a diagram illustrating a state where a seal material is attached to a body of the fuel injection valve in FIG. 1, the state being prior to insertion of the body into an attachment hole of the engine.

FIG. 2 is an enlarged view illustrating a state before inserting the fuel injection valve 1 into the attachment hole 4. Shapes of the body 10 and the seal material 40 will be described in detail below with reference to FIG. 2.

The body 10 includes a nozzle hole part 11 which is a part having the nozzle hole 10*a*, and a basal part 12 having a shape which extends in a direction of the central line C (axial direction) and accommodates the valving element 20. A groove portion 15 and a first reduced diameter part 16 are provided in this order for a part of the body 10 that is continuous from the nozzle hole part 11 to an opposite side of the nozzle hole 10*a*. The groove portion 15 and the first reduced diameter part 16 are formed in a shape obtained by radially reducing the body 10, and their diameters are smaller than that of the basal part 12. In a state before inserting the fuel injection valve 1 in the attachment hole 4, the seal material 40 is attached to the groove portion 15 and the first reduced diameter part 16.

A first tapered part 14, a parallel part 17, and a second tapered part 18 are formed in this order at a part of the body 10 that is continuous from the first reduced diameter part 16 to the opposite side of the nozzle hole 10*a*. Thus, the parallel part 17 is located and connected continuously between the first tapered part 14 and the second tapered part 18. A part of the body 10 that is continuous from the second tapered part 18 to the opposite side of the nozzle hole 10*a* is the basal part 12. The first tapered part 14, the parallel part 17, and the second tapered part 18 are formed in a shape obtained by radially reducing the body 10, and their diameters are smaller than that of the basal part 12. The parallel part 17 and the second tapered part 18 may correspond to a "second reduced diameter part".

An outer diameter size D11 of the nozzle hole part 11 and an outer diameter size D12 of the basal part 12 are the same. Accordingly, all of the groove portion 15, the first reduced diameter part 16, the first tapered part 14, the parallel part 17, and the second tapered part 18, which are located between the nozzle hole part 11 and the basal part 12, can also be the parts whose diameters are reduced relative to the nozzle hole part 11 and the basal part 12.

A diameter size of the parallel part 17 is the same along the axial direction of the body 10. An axial length of the second tapered part 18 is shorter than axial length of the first tapered part 14. Cutting work is performed on the groove portion 15, the first reduced diameter part 16, the first tapered part 14, the parallel part 17, and the second tapered part 18 such that their surface roughnesses are all the same. In addition, cutting work is performed such that surface roughness of the first tapered part 14 is smaller than surface roughness of an outer peripheral surface of a part 13 (see FIG. 1) of the body 10 that accommodates the electric actuator 30.

The first tapered part 14 and the second tapered part 18 are formed in such a shape that the diameter size of the body 10 increases gradually toward the opposite side from the nozzle hole 10*a*. Outer peripheral surfaces of the first reduced diameter part 16 and the parallel part 17 are formed in a shape whose diameter size is the same. A part of the groove portion 15 having the smallest diameter size is referred to as a bottom surface 15*a*; a part of the groove portion 15 that is continuous from the bottom surface 15*a* to the nozzle hole part 11 is referred to as a nozzle-hole side wall surface 15*b*; and a part of the groove portion 15 that is continuous from the bottom surface 15*a* to the first reduced diameter part 16 is referred to as a nozzle-hole opposite side wall surface 15*c*. The bottom surface 15*a* is formed in a shape whose diameter size is the same. The nozzle-hole opposite side wall surface

15*c* is formed in a tapered shape whose diameter size increases gradually toward the opposite side from the nozzle hole 10*a*. The nozzle-hole side wall surface 15*b* is formed in a shape spreading perpendicularly to the axial direction.

A taper angle θ1 of the first tapered part 14, and a taper angle θ2 of the second tapered part 18 (see FIG. 5) are set respectively in a range from 10 degrees to 20 degrees. Specifically, these taper angles θ1, θ2 are set at 15 degrees. The taper angle is an angle at which an imaginary line extending in the axial direction and a contour line of the body 10 intersect with each other when viewed in section of the body 10. The taper angle of the nozzle-hole opposite side wall surface 15*c* is larger than the taper angles θ1, θ2 of the first tapered part 14 and the second tapered part 18. The taper angles of the first reduced diameter part 16, the parallel part 17, and the bottom surface 15*a* may be zero degrees.

The seal material 40 is attached to the body 10 to overstride across both the first reduced diameter part 16 and the groove portion 15. An end part 41 of the seal material 40 on the nozzle hole 10*a*-side is fitted in the groove portion 15, and the other part (hereinafter referred to as a main body part 42) of the seal material 40 is attached to the first reduced diameter part 16. In this attachment state, the main body part 42 may be configured to be elastically-deformed and closely-attached on the first reduced diameter part 16, or may be configured to define a clearance between the main body part 42 and the first reduced diameter part 16.

Before its attachment to the first reduced diameter part 16, the seal material 40 has a cylindrical shape with even thickness. After its attachment to the first reduced diameter part 16, the main body part 42 has a shape with an even diameter size at any position in the axial direction. The end part 41 after its attachment is formed in a shape whose outer diameter size is reduced gradually toward the nozzle hole 10*a*. The whole of an end surface 41*a* of the end part 41 on the nozzle hole 10*a*-side is located in the groove portion 15.

More specifically, a part of the end surface 41*a* of the end part 41 on the nozzle hole 10*a*-side, which is an inner circumferential corner and is an annularly extending ridge-line, is referred to as an inside corner 41*b*. A part of the end surface 41*a*, which is an outer circumferential corner and is an annularly extending ridgeline, is referred to as an outside corner 41*c*. The inside corner 41*b* is located on the bottom surface 15*a* of the groove portion 15, and the outside corner 41*c* is located on the nozzle-hole side wall surface 15*b* of the groove portion 15. In other words, the outside corner 41*c* is located radially inward of an outer peripheral surface of the nozzle hole part 11. An outer peripheral surface of the main body part 42 of the seal material 40 is located radially outward of the outer peripheral surface of the nozzle hole part 11. Accordingly, an outer diameter size D40 of the main body part 42 is larger than the outer diameter size D11 of the nozzle hole part 11. The inside corner 41*b* and the bottom surface 15*a* may be in contact, or may be separated. The outside corner 41*c* and the nozzle-hole side wall surface 15*b* may be in contact, or may be separated.

Figure 3:
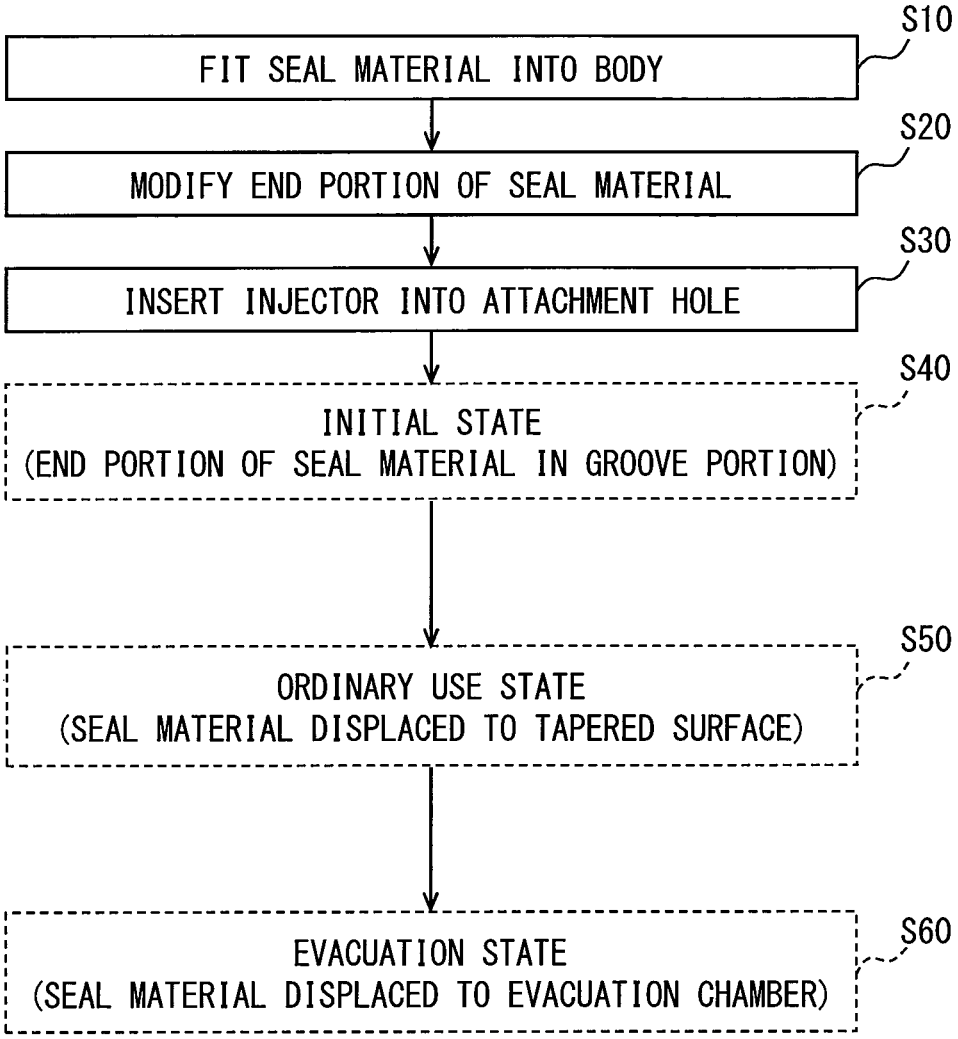
FIG. 3 is a diagram illustrating a procedure for attaching the fuel injection valve in FIG. 1 to the engine.

With reference to FIG. 3, a procedure for operations (i.e., method of attachment) to attach the seal material 40 to the body 10 and to attach the fuel injection valve 1 in the attachment hole 4 will be described.

Figure 4:
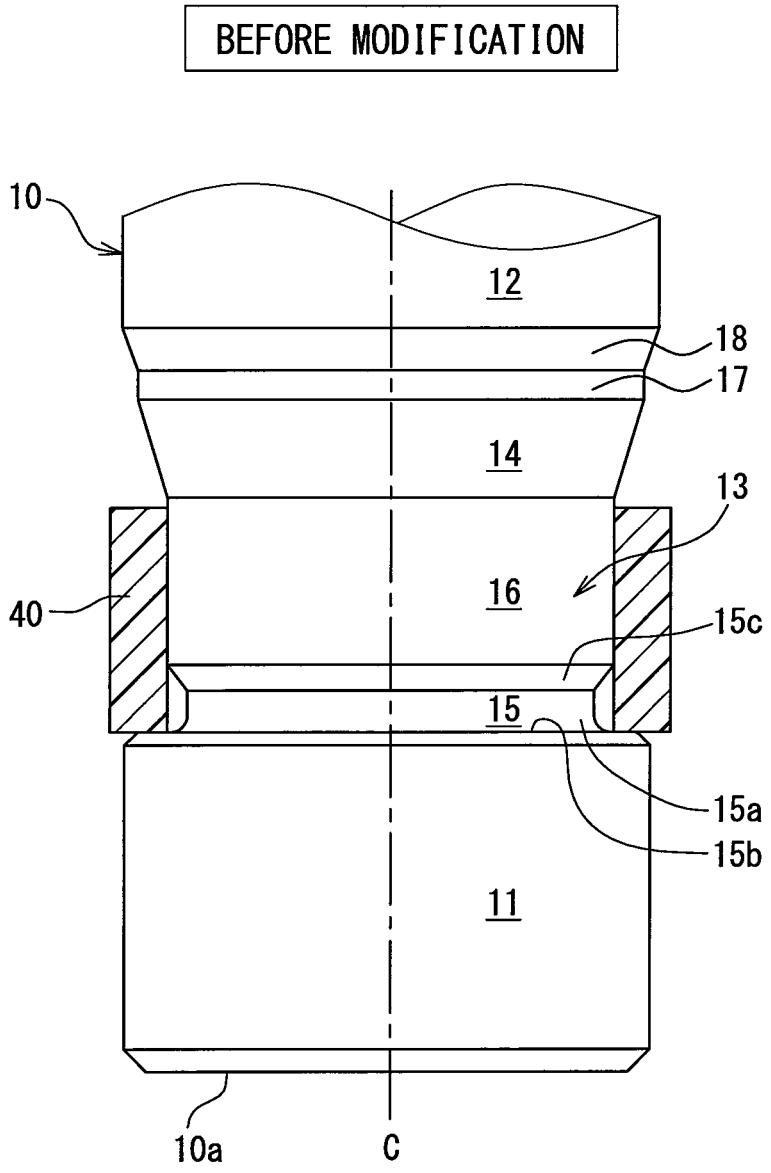
FIG. 4 is a diagram illustrating a state before modification of a seal material in a seal attachment process in FIG. 3.

First, in a first attachment process S10, the seal material 40 is fitted to the body 10. Specifically, the seal material 40 is fitted around the first reduced diameter part 16 from the nozzle hole part 11-side with the seal material 40 elastically-deformed in the radial direction. At this stage, as illustrated in FIG. 4, there is not formed the end part 41 having a shape whose diameter is reduced, and the seal material 40 is formed in a shape whose diameter size is the same.

Next, in a second attachment process S20, the end part of the seal material 40 on the nozzle hole 10*a*-side is plastically-deformed to form the end part 41 having a shape whose diameter is reduced (see FIG. 2). For example, by pressing the end part of the seal material 40 on the nozzle hole 10*a*-side against the inside of the groove portion 15 by way of a jig, the end part 41 is plastically-deformed (i.e., modified) into a shape whose diameter is reduced and which is fitted into the groove portion 15. These processes S10, S20 may correspond to a "seal attachment process."

Figure 5:
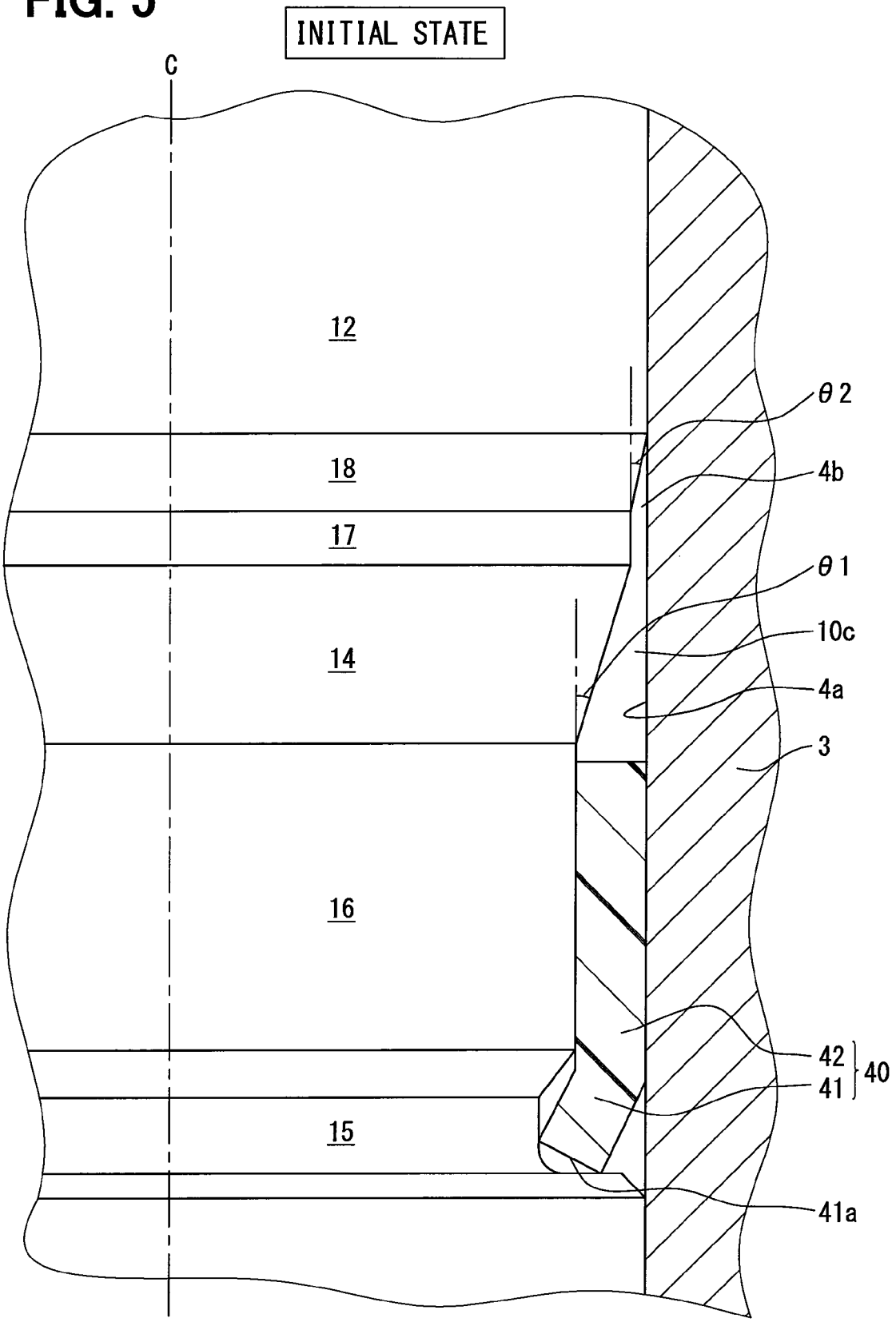
FIG. 5 is a diagram illustrating an initial state at the point of completion of the attachment of the fuel injection valve in the seal attachment process in FIG. 3.

Subsequently, in an insertion process S30, the fuel injection valve 1 with the modified seal material 40 attached to the body 10 is inserted into the attachment hole 4. FIG. 5 illustrates a state (hereinafter described as an initial state) at the point when the fuel injection valve 1 is inserted up to a predetermined position to complete the insertion process. FIG. 5 illustrates that the end part 41 of the seal material 40 remains fitted in the groove portion 15, and that the main body part 42 of the seal material 40 is clamped between the inner peripheral surface 4*a* of the attachment hole 4 and the first reduced diameter part 16 to be elastically-deformed in the radial direction.

In the process of insertion of the fuel injection valve 1 into the attachment hole 4, the outer peripheral surface of the seal material 40 is rubbed against the inner peripheral surface 4*a* of the attachment hole 4 Because of this friction, force in a direction to pull up the seal material 40 (hereinafter described as friction elevating force) is applied to the seal material 40. However, because the end part 41 is caught in the groove portion 15, the end part 41 easily remains in the groove portion 15 against the friction elevating force, as illustrated in FIG. 5.

In the above initial state, when a gas pressure in the combustion chamber 2 which is lower than a predetermined pressure (e.g., gas pressure at the time of idle operation of the engine) is applied to the seal material 40 from the nozzle hole 10*a*-side, force in a direction to push up the seal material 40 (hereinafter described as gas upheaving force) is applied to the seal material 40. Specifically, the gas pressure is applied to all of the end surface 41*a*, the outer peripheral surface, and the inner peripheral surface of the end part 41, and the gas upheaving force acts thereon. Against this gas upheaving force to push up the end part 41 toward the opposite side from the nozzle hole 10*a*, the end part 41 remains in the groove portion 15 since the end part 41 is caught in the groove portion 15 (see FIG. 5). In this case, the end part 41 is pressed on the nozzle-hole opposite side wall surface 15*c* by the gas upheaving force to be compressively-deformed. A clearance between the inner peripheral surface 4*a* of the attachment hole 4 and the outer peripheral surface of the body 10 is sealed with this compressively-deformed portion of the seal material 40 (see S40 in FIG. 3).

Figure 6:
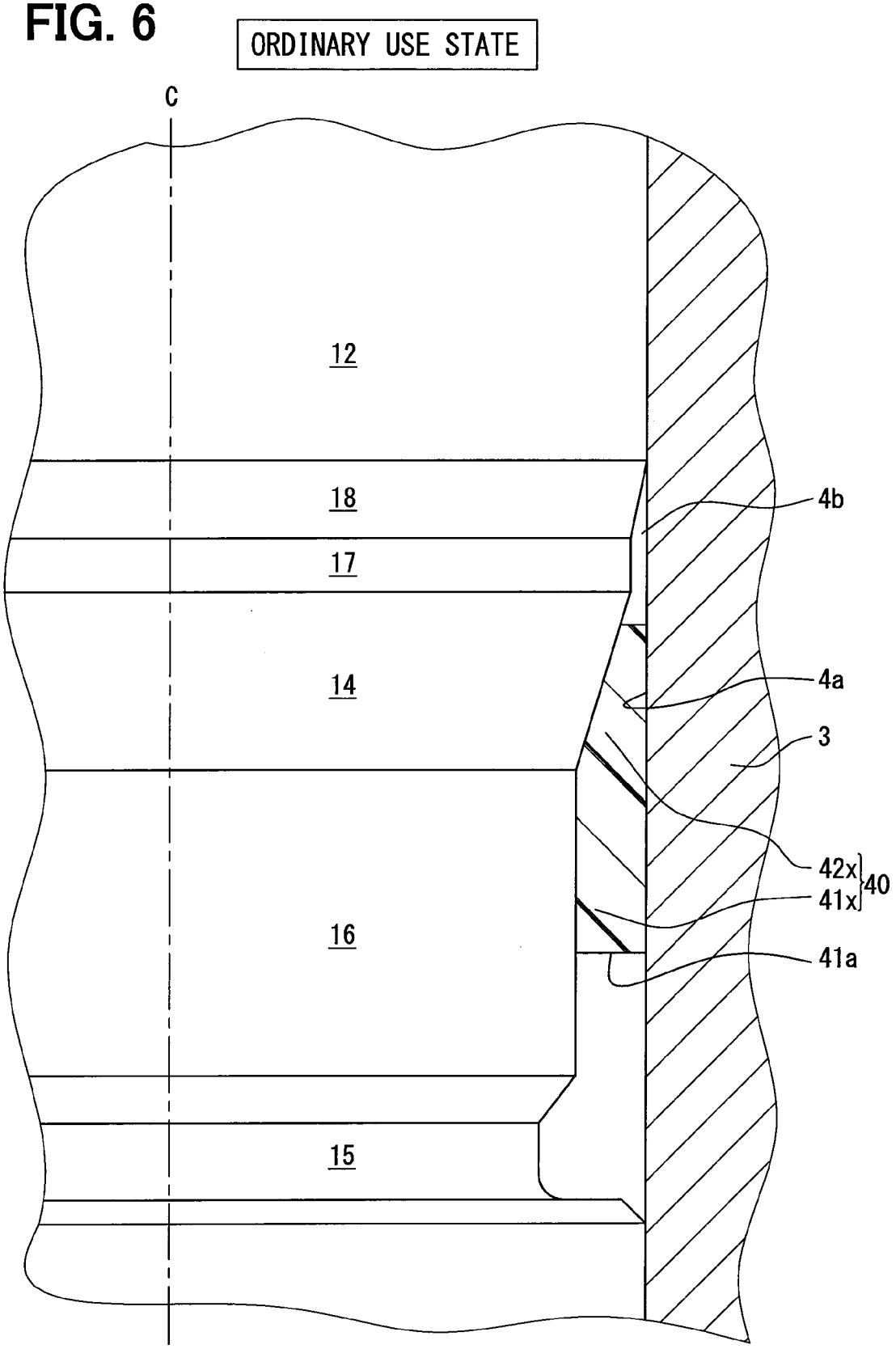
FIG. 6 is a diagram illustrating an ordinary use state after gas pressure is applied to the seal material in the seal attachment process in FIG. 3.

Then, the gas pressure in the combustion chamber 2 rises in accordance with a load increase of the engine. When the gas pressure applied from the nozzle hole 10*a*-side of the seal material 40 reaches a predetermined pressure or higher, the above-described gas upheaving force increases to disengage the end part 41 from the groove portion 15, so that the seal material 40 is pushed up toward the opposite side from the nozzle hole 10*a* (see FIG. 6). Accordingly, the end part 41 is located on the first reduced diameter part 16, and a part of the main body part 42 on the opposite side from the nozzle hole 10*a* enters into a clearance 10*c* between the first tapered part 14 and the inner peripheral surface 4*a* of the attachment hole 4 so as to be located on the first tapered part 14. In an ordinary use state in FIG. 6, the part of the seal material 40 located on the first tapered part 14 is hereinafter referred to as a normal time main body part 42*x*, and the part of the seal material 40 located on the first reduced diameter part 16 is hereinafter referred to as a normal time end part 41*x*.

In the above ordinary use state, the gas pressure is applied to the end face 41*a* of the normal time end part 41, and the gas upheaving force acts on the seal material 40. By this gas upheaving force, the normal time main body part 42*x* is pressed on the first tapered part 14 (see FIG. 6). As a result, the entire seal material 40 is compressively-deformed. Specifically, the seal material 40 is clamped between the inner peripheral surface 4*a* of the attachment hole 4 and the first tapered part 14. Consequently, the compressive deformation of the seal material 40 in the radial direction is promoted so that the radial surface pressure of the seal material 40 increases (this phenomenon is hereinafter referred to as a wedge effect). As a consequence, a clearance between the inner peripheral surface 4*a* of the attachment hole 4 and the outer peripheral surface of the body 10 (i.e., the first tapered part 14) is sealed (see S50 in FIG. 3).

If this ordinary use state is continued for a long time, the seal material 40 deteriorates due to a creep phenomenon, and the above-described surface pressure relative to a radial deformation amount of the seal material 40 is thereby reduced. However, when the seal material 40 deteriorates in this manner, the seal material 40 is further pushed up by the gas upheaving force so that the radial deformation amount of the seal material 40 increases. Accordingly, while the surface pressure relative to the radial deformation amount reduces, the surface pressure in the ordinary use state is maintained because of the increase of the radial deformation amount. Thus, the seal capacity by the wedge effect is maintained.

Figure 7:
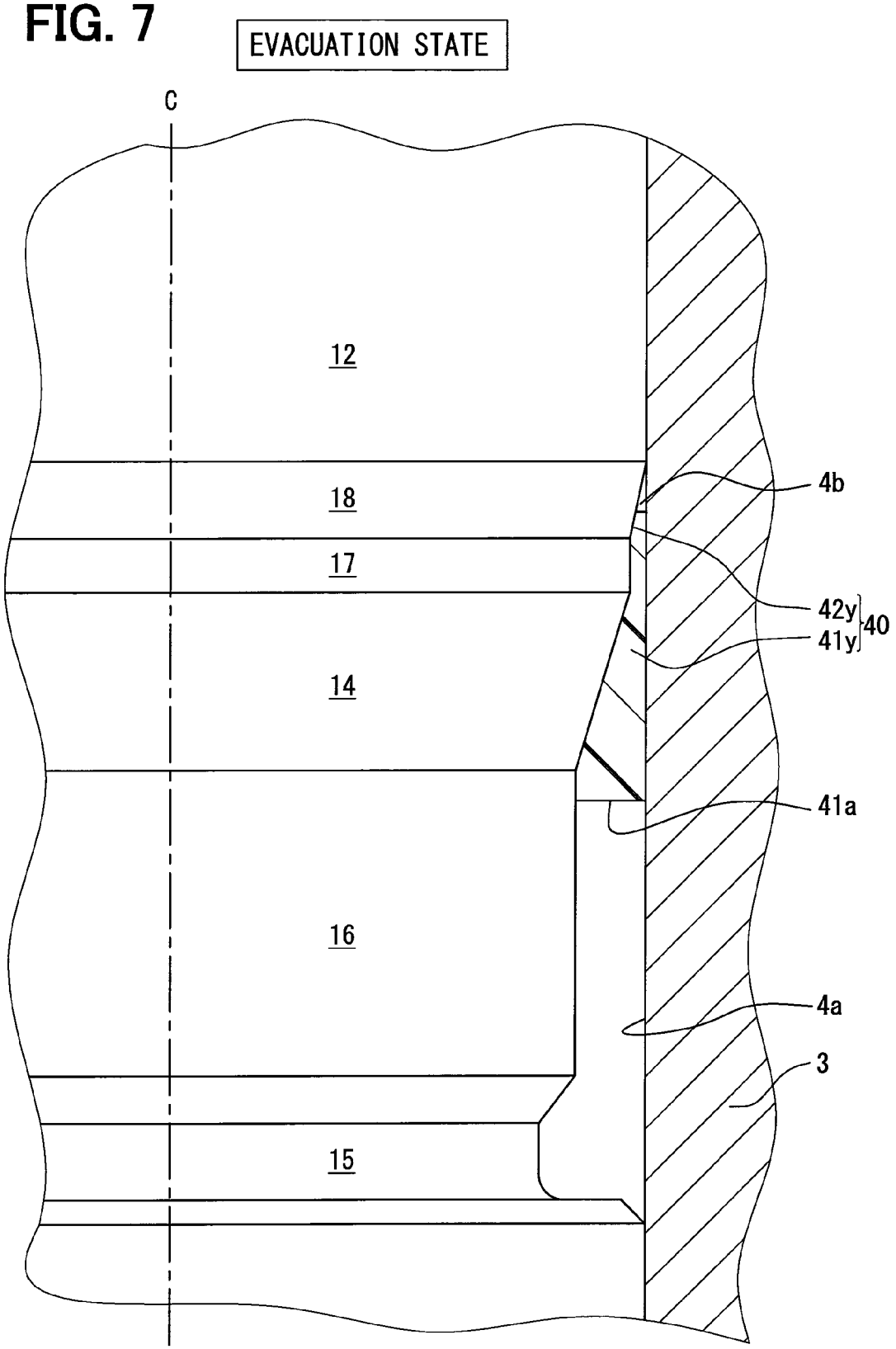
FIG. 7 is a diagram illustrating a use state after the gas pressure is applied to the seal material in the seal attachment process in FIG. 3 with the seal material displaced into an evacuation chamber in the state.

If the ordinary use state is continued for an even longer time and the deterioration of the seal material 40 due to its creep progresses, the seal material 40 is pushed up further by the gas upheaving force, and a part of the normal time main body part 42*x* is inserted into an evacuation chamber 4*b* (see FIG. 7). The evacuation chamber 4*b* is a clearance formed between outer peripheral surfaces of the parallel part 17 and the second tapered part 18 and the inner peripheral surface 4*a* of the attachment hole 4.

As a result, the seal material 40 is clamped between the inner peripheral surface 4*a* of the attachment hole 4 and the second tapered part 18. A part of the normal time main body part 42*x* is located on the second tapered part 18, and a part of the normal time end part 41*x* is located on the parallel part 17. In an evacuation state in FIG. 7, the part of the seal material 40 located on the second tapered part 18 is hereinafter referred to as an evacuation time main body part 42*y*, and the part of the seal material 40 located on the parallel part 17 is hereinafter referred to as an evacuation time end part 41*y*.

In the above-described evacuation state, the gas pressure is applied to the end face 41*a* of the evacuation time end part 41*y* and the gas upheaving force acts on the seal material 40. By this gas upheaving force to push up the seal material 40 toward the opposite side from the nozzle hole 10*a*, the evacuation time main body part 42*y* and the evacuation time end part 41*y* are pressed respectively against the second tapered part 18 and the first tapered part 14 (see FIG. 7). As a result, in addition to the first tapered part 14, the second tapered part 18 also produces the wedge effect. Accordingly, a clearance between the inner peripheral surface 4*a* of the attachment hole 4 and the outer peripheral surface of the body 10 (i.e., the first tapered part 14 and the second tapered part 18) is sealed (see S60 in FIG. 3).

A clearance necessary for the body 10 to be inserted into the attachment hole 4 is provided between an outer peripheral surface of the basal part 12 and the inner peripheral surface 4*a* of the attachment hole 4. This clearance is set to have such a small size that the seal material 40 cannot enter into the clearance by the gas upheaving force. Accordingly, in the evacuation state, when the evacuation time main body part 42*y* reaches a boundary position between the second tapered part 18 and the basal part 12, the evacuation time main body part 42*y* cannot be pushed up any further. Thus, if the evacuation time main body part 42*y* reaches this boundary position, after that, the surface pressure owing to progression of the wedge effect cannot be ensured so that the seal capacity is decreased. In consideration of this regard, the fuel injection valve 1 is set such that the evacuation time main body part 42*y* does not reach the boundary position within a durable period of the fuel injection valve 1.

In sum, the fuel injection valve 1 of the above-described present embodiment has characteristics enumerated below. The operations and effects, which will be described below, are provided by these characteristics.

The first characteristic will be described. The taper angle θ1 of the first tapered part 14 is set in a range from 10 degrees to 20 degrees. The effect by this setting will be described below using test results in FIGS. 8 and 9.

Figure 8:
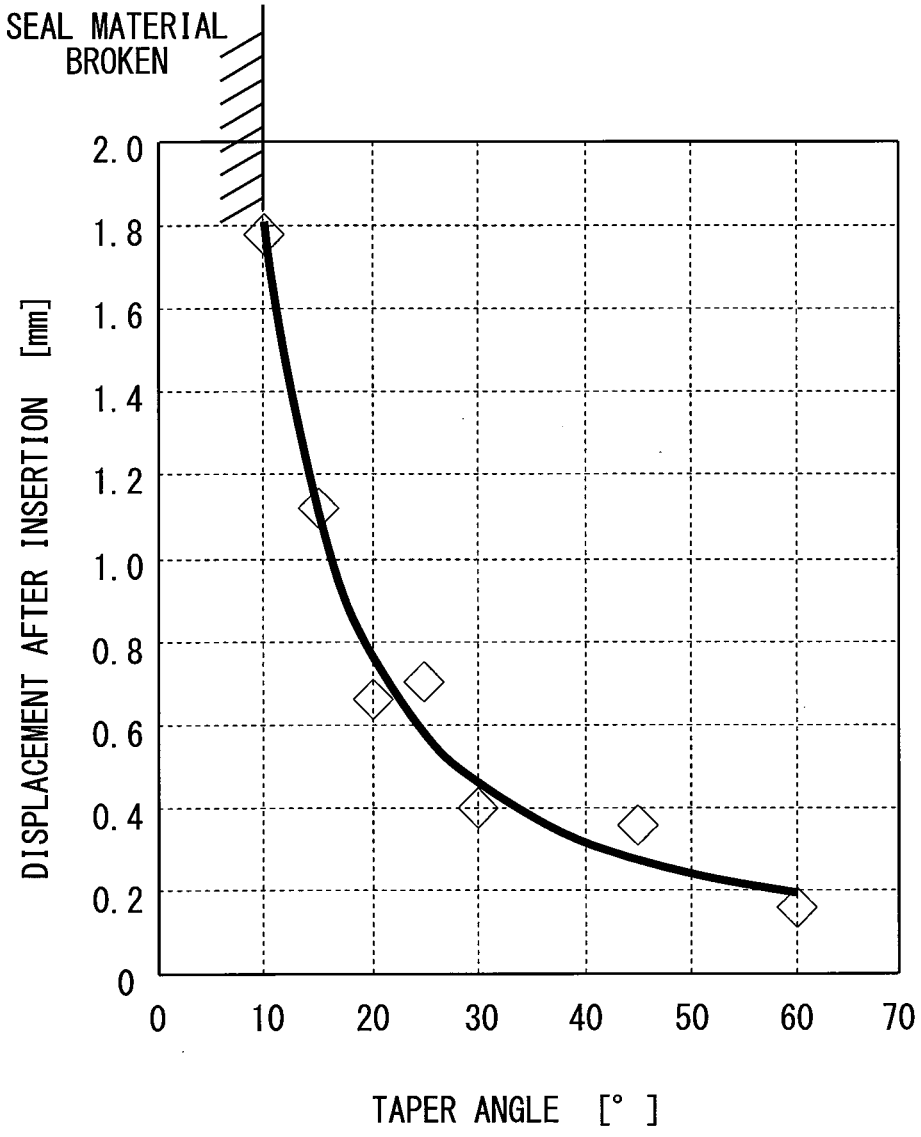
FIG. 8 is a diagram illustrating a test result that indicates a relationship between displacement of the seal material caused at the time of insertion of the seal material into the attachment hole of the first embodiment, and a taper angle.

In the test in FIG. 8, after the insertion of the body 10 into the attachment hole 4 with the seal material 40 attached to the body 10, a distance that is axially traveled by the end surface 41*a* of the seal material 40 is measured. In the test in FIG. 9, in a state where the fuel injection valve 1 is attached to the attachment hole 4 and then the gas upheaving force is applied to produce the wedge effect, the flow rate of gas leaking out of the seal material 40 is measured.

Figure 9:
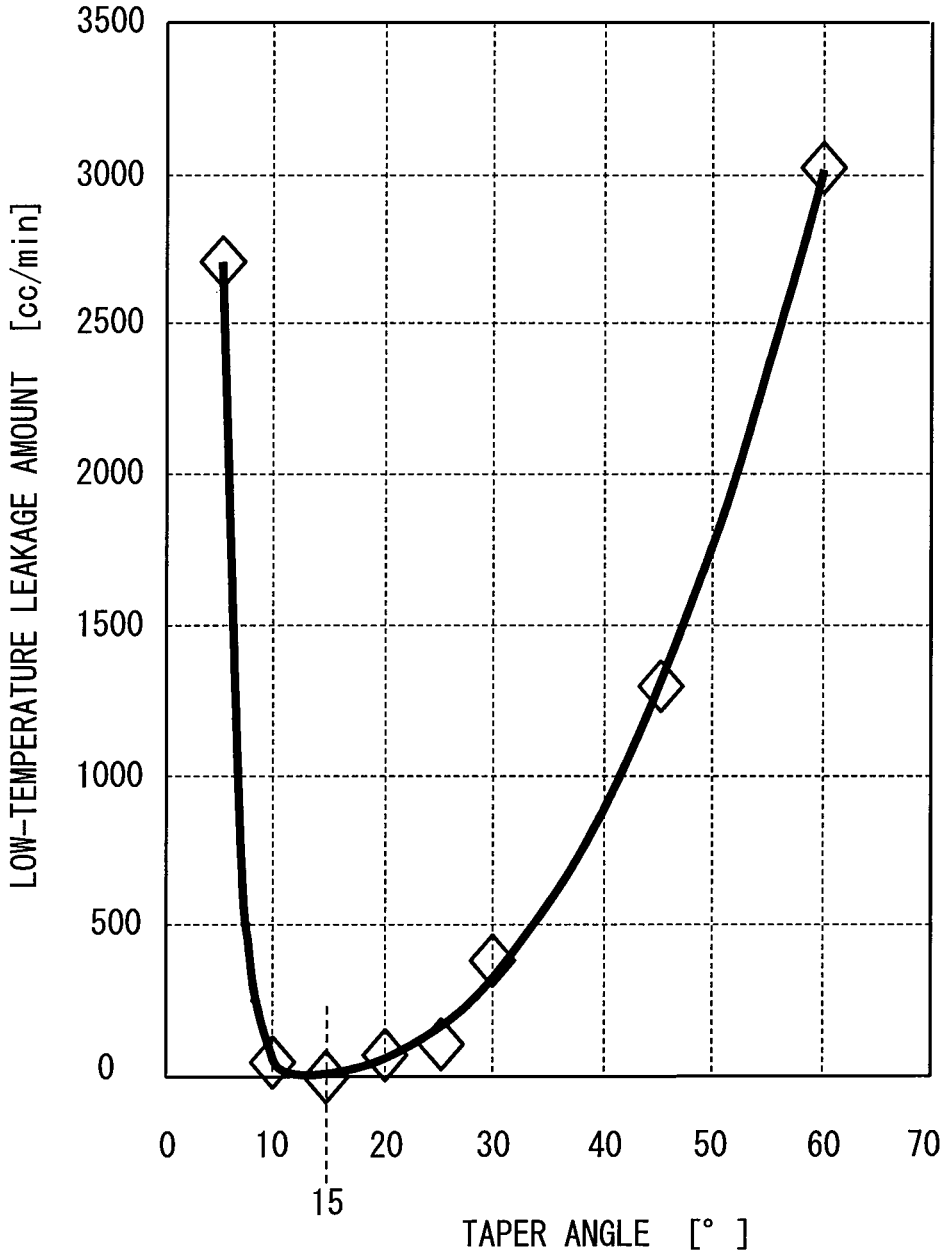
FIG. 9 is a diagram illustrating a test result that indicates a relationship between a gas leakage amount and the taper angle according to the first embodiment.

The horizontal axes in FIGS. 8 and 9 indicate the taper angle of the first tapered part 14, and the above tests are carried out with the taper angle changed in respect to eight points: 5 degrees, 10 degrees, 15 degrees, 20 degrees, 25 degrees, 30 degrees, 45 degrees, and 60 degrees. In the test in FIG. 8, at the taper angle of 5 degrees, the seal material 40 is broken, so that the displacement cannot be measured. In contrast, in the test in FIG. 9, the seal material 40 is not broken despite at the taper angle of 5 degrees. It is inferred that such a difference between the presence and absence of breaking is made because the fuel injection valve with the maximum dimensional tolerance is used in the test in FIG. 8 and the fuel injection valve with the minimum dimensional tolerance is used in the test in FIG. 9.

The test result in FIG. 8 indicates that at the taper angle of 10 degrees or larger, the displacement of the seal material 40 caused at the time of insertion of the body 10 into the attachment hole 4 can be limited to the extent that the seal material 40 is not damaged. The test result in FIG. 9 indicates that at the taper angle of 20 degrees or smaller, the sealing properties by the wedge effect can be sufficiently achieved.

Accordingly, in the present embodiment with the taper angle θ1 set to be equal to or larger than 10 degrees and to be equal to or smaller than 20 degrees, there can be realized a compatibility between the limitation of the displacement of the seal material 40 caused at the time of insertion of the body 10 into the attachment hole 4 to limit the damage to the seal material 40, and the improvement in sealing properties by the wedge effect.

The second characteristic will be described below. At a part of the outer peripheral surface of the body 10 that is continuous with the first tapered part 14 on the opposite side of the first tapered part 14 from the nozzle hole 10*a*, there is formed the second reduced diameter part (i.e., the parallel part 17 and the second tapered part 18) that has a shape obtained by radially reducing the body 10. This second reduced diameter part defines a clearance (i.e., evacuation chamber 4*b*) in combination with the inner peripheral surface 4*a* of the attachment hole 4.

In case of the sealing surface pressure of the seal material 40 reduced by creep, the wedge effect, by which the seal material 40 is scraped up along the first tapered part 14 to increase the sealing surface pressure, is not produced after the seal material 40 has been rubbed up to a limit position. In the present embodiment in recognizing the importance of this regard, there is formed the second reduced diameter part which is continuous with the first tapered part 14 on the opposite side of the first tapered part 14 from the nozzle hole 10*a*. Accordingly, the evacuation chamber 4*b* is provided adjacently to the opposite side of the first tapered part 14 from the nozzle hole 10*a*. As a result, after the end portion of the seal material 40 (i.e., normal time main body part 42*x*) has been rubbed up to the end part of the first tapered part 14 on the opposite side from the nozzle hole 10*a*, the normal time main body part 42*x* can proceed into the evacuation chamber 4*b*, and therefore the seal material 40 can further scrape up. As a result, there can be delayed the timing at which the wedge effect is no longer produced, and there can be prolonged the life of the seal material 40 during which the seal capacity is demonstrated.

The third characteristic will be described below. The second reduced diameter part (i.e., the parallel part 17 and the second tapered part 18) includes the parallel part 17 whose diameter size of the body 10 is the same in the axial direction of the body 10. Accordingly, the evacuation chamber 4*b* can be formed with axial enlargement of the body 10 limited.

The fourth characteristic will be described below. The second reduced diameter part (i.e., the parallel part 17 and the second tapered part 18) includes the second tapered part 18 whose diameter size of the body 10 increases gradually toward the opposite side from the nozzle hole 10*a*. The parallel part 17 is located between the first tapered part 14 and the second tapered part 18.

Accordingly, the end of the normal time main body part 42*x* (i.e., evacuation time main body part 42*y*) entering into the evacuation chamber 4*b* is pressed further on the second tapered part 18, thereby producing the wedge effect. Thus, sealing properties of the seal material 40 can be improved.

The fifth characteristic will be described below. The taper angle θ2 of the second tapered part 18 is set in a range from 10 degrees to 20 degrees. Accordingly, similarly, the second tapered part 18 also produces the above-described effect by the first tapered part 14, i.e., the effect of striking a balance between the restriction of movement of the seal material 40, and the improvement in sealing properties by the wedge effect.

The sixth characteristic will be described below. The body 10 is formed such that the surface roughness of the first tapered part 14 is smaller than the surface roughness of the outer peripheral surface of the part 13 of the body 10 that accommodates the electric actuator 30.

Accordingly, because of the small surface roughness of the first tapered part 14, close attachment between the first tapered part 14 and the seal material 40 can be improved. Thus, sealing properties between the seal material 40 and the body 10 can be improved. By making the surface roughness small in this manner, the seal material 40 is easily rubbed up. Therefore, an inhibitory effect on rubbing up owing to the taper angle θ1 of 10 degrees or larger is suitably produced.

The seventh characteristic will be described below. The annular groove portion 15, which is recessed in the radial direction of the body 10, is formed at a part of the first reduced diameter part 16 on which the nozzle hole-side end part 41 of the seal material 40 is attached.

Accordingly, the body 10 can be inserted into the attachment hole 4 with the end part 41 of the seal material 40 engaged with the groove portion 15. As a result, the main body part 42 of the seal material 40 is restrained from being drawn upward by the frictional force (i.e., friction elevating force) between the seal material 40 and the attachment hole 4 at the time of this insertion. Consequently, the seal material 40 can be restricted from being strongly rubbed or damaged at the time of insertion between the inner peripheral surface 4*a* of the attachment hole 4 and the first tapered part 14.

Moreover, at the time of performing operation of taking the fuel injection valve 1 out of the attachment hole 4, the body 10 can be taken out from the attachment hole 4 with the end part 41 of the seal material 40 caught in the groove portion 15. Accordingly, the normal time end part 41*x* of the seal material 40 can be prevented from being dragged down to the position on the nozzle hole-side of the groove portion 15, i.e., onto an outer peripheral surface of the nozzle hole part 11 by the frictional force (i.e., friction lowering force) between the seal material 40 and the attachment hole 4 at the time of this operation of taking out the valve 1. Hence, the end part 41 can be restrained from being shifted from a predetermined position of the body 10, i.e., from the position on the opposite side of the nozzle hole part 11 from the nozzle hole 10*a* (i.e., groove portion 15) toward the nozzle hole 10*a*. As a result, there can be avoided a reduction in efficiency of the operation of taking the fuel injection valve 1 out of the attachment hole 4 because of the seal material 40 biting between the inner peripheral surface 4*a* of the attachment hole 4 and the outer peripheral surface of the nozzle hole part 11.

The eighth characteristic will be described below. The end part 41 of the seal material 40 at the time of insertion is formed in a cylindrical shape whose outer diameter size is reduced gradually toward the nozzle hole 10*a*. Accordingly, at the time of insertion, an outer peripheral surface of the end part 41 can be restricted from being scraped against the inner peripheral surface 4*a* of the attachment hole 4. Thus, disengagement of the end part 41 from the groove portion 15 due to the friction elevating force can be limited.

The ninth characteristic will be described below. The entire end surface 41*a* of the end part 41 on the nozzle hole-side is located in the groove portion 15. Accordingly, at the time of insertion, the outside corner 41*c* of the end part 41 is located in the groove portion 15. As a result, at the time of insertion, the outside corner 41*c* of the end part 41 can be even further restrained from being rubbed on the inner peripheral surface 4*a* of the attachment hole 4. Therefore, the effect of limiting the separation of the end part 41 from the groove portion 15 due to the friction elevating force can be improved.

The tenth characteristic will be described below. The first tapered part 14, whose diameter size of the body 10 increases gradually toward the opposite side from the nozzle hole 10*a*, is formed at a part of the outer peripheral surface of the body 10 that is continuous with the first reduced diameter part 16 on the opposite side of the first reduced diameter part 16 from the nozzle hole 10*a*. The configuration is provided such that in the ordinary use state, the seal material 40 is pressed on the first tapered part 14 by the above gas pressure to be compressively-deformed, and the clearance between the inner peripheral surface 4*a* of the attachment hole 4 and the outer peripheral surface of the body 10 is sealed with this compressively-deformed portion.

Accordingly, because the seal material 40 is pressed on the first tapered part 14 by the above-described gas upheaving force, the seal capacity by the wedge effect is maintained despite the progression of creep deterioration of the seal material 40.

In addition, as compared to the case where the first tapered part 14 is not provided, the generation of shear force or tensile force in the seal material 40 by the gas upheaving force can be limited, and potential damage to the seal material 40 can thereby be reduced. Particularly, if the fuel injection valve 1 is attached to a position at which to inject fuel directly into the combustion chamber 2, high gas pressure in the combustion chamber 2 is applied, and therefore the above effect is prominently produced.

The eleventh characteristic will be described below. The configuration is provided such that in the initial state where a gas pressure that is a predetermined pressure or higher is not yet applied to the seal material 40 after the insertion of the body 10 into the attachment hole 4 has been completed, sealing is performed by the seal material 40 in the following manner. Specifically, the configuration is provided such that the seal material 40 is clamped between the wall surface 15*c* of the groove portion 15 on its opposite side from the nozzle hole 10*a* and the inner peripheral surface 4*a* of the attachment hole 4 to be compressively-deformed, and that the above clearance between the inner peripheral surface 4*a* and the outer peripheral surface of the body 10 is sealed with this compressively-deformed portion.

Accordingly, even in the initial state, the clearance between the inner peripheral surface 4*a* of the attachment hole 4 and the outer peripheral surface of the body 10 can be sealed. As a result, a possibility that the gas in the combustion chamber 2 may leak out to the outside through the attachment hole 4 can be limited not only at the time of ordinary use but also at the time of the initial state.

The twelfth characteristic will be described below. In a state where the body 10 is not inserted in the attachment hole 4, the outermost diameter size D40 of the seal material 40 is set to be larger than an inner diameter size D4 of the inner peripheral surface 4*a* of the attachment hole 4.

Accordingly, both in the initial state and in the ordinary use state, there can be improved the reliability of the outer peripheral surface of the seal material 40 being closely-attached on the inner peripheral surface 4*a* of the attachment hole 4, and of the inner peripheral surface of the seal material 40 being closely-attached on the outer peripheral surface of the body 10. Thus, sealing properties by the seal material 40 can be improved.

The thirteenth characteristic will be described below. In a state where the body 10 is not inserted in the attachment hole 4, the outermost circumferential position of the seal material 40, with the seal material 40 attached to the first reduced diameter part 16, is located radially outward of the outermost circumferential position of the nozzle hole-side wall surface of the groove portion 15. FIG. 2 illustrates that this outermost circumferential position of the seal material 40 is the outer peripheral surface position of the main body part 42. FIG. 2 illustrates that the above outermost circumferential position of the nozzle hole-side wall surface of the groove portion 15 is the outermost peripheral surface position of the nozzle-hole side wall surface 15*a*, i.e., the outer peripheral surface position of the nozzle hole part 11.

Accordingly, both in the initial state and in the ordinary use state, there can be improved the reliability of the outer peripheral surface of the seal material 40 being closely-attached on the inner peripheral surface 4*a* of the attachment hole 4, and of the inner peripheral surface of the seal material 40 being closely-attached on the outer peripheral surface of the body 10. Thus, sealing properties by the seal material 40 can be improved.

The fourteenth characteristic will be described below. The wall surface 15*c* of the groove portion 15 on its opposite side from the nozzle hole 10*a* is formed into a tapered shape whose diameter size of the body 10 increases gradually toward the opposite side from the nozzle hole 10*a*.

Contrary to the present embodiment, if the nozzle-hole opposite side wall surface 15*c* is formed into a right-angled shape in section, there is concern that when the seal material 40 is displaced toward its opposite side from the nozzle hole 10*a* by the gas upheaving force, the end part 41 cannot be removed smoothly from the groove portion 15. On the other hand, in the present embodiment, because the nozzle-hole opposite side wall surface 15*c* is formed in a tapered shape, the end part 41 can be separated smoothly from the groove portion 15 by the gas upheaving force, so that this concern can be resolved.

(Second Embodiment)

Figure 10:
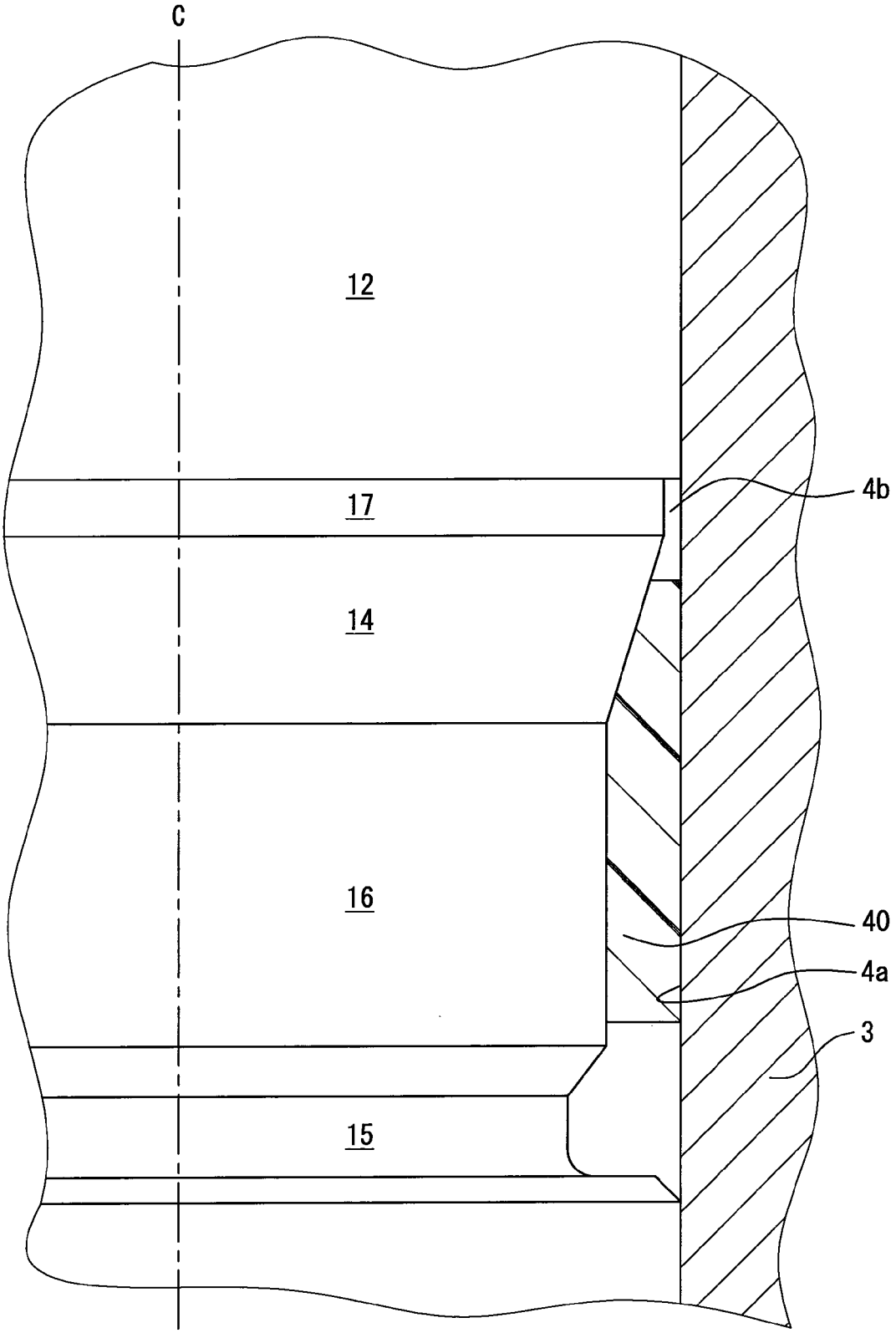
FIG. 10 is a diagram illustrating an ordinary use state after gas pressure is applied to a seal material in a fuel injection valve in accordance with a second embodiment.

In the present embodiment illustrated in FIG. 10, the second tapered part 18 of the above first embodiment is eliminated. Specifically, a first tapered part 14, a parallel part 17, and a basal part 12 are formed in this order at a part of a body 10 that is continuous from a first reduced diameter part 16 on its opposite side from a nozzle hole 10*a*. The parallel part 17 is located between the first tapered part 14 and the basal part 12 to be connected continuously therebetween. In this case, the parallel part 17 may correspond to a "second reduced diameter part", and a clearance formed between an outer peripheral surface of the parallel part 17 and an inner peripheral surface 4*a* of an attachment hole 4 serves as an evacuation chamber 4*b*.

As above, even in the configuration with the elimination of the second tapered part 18, the evacuation chamber 4*b* is defined by the parallel part 17. Accordingly, after an end part of a seal material 40 has been rubbed up to an end portion of the first tapered part 14 on its opposite side from the nozzle hole 10*a*, the end part of the seal material 40 can proceed into the evacuation chamber 4*b*. Thus, similar to the first embodiment, there can be delayed the timing at which the wedge effect is no longer produced, and there can be prolonged the life of the seal material 40 during which a seal capacity is demonstrated.

(Third Embodiment)

Figure 11:
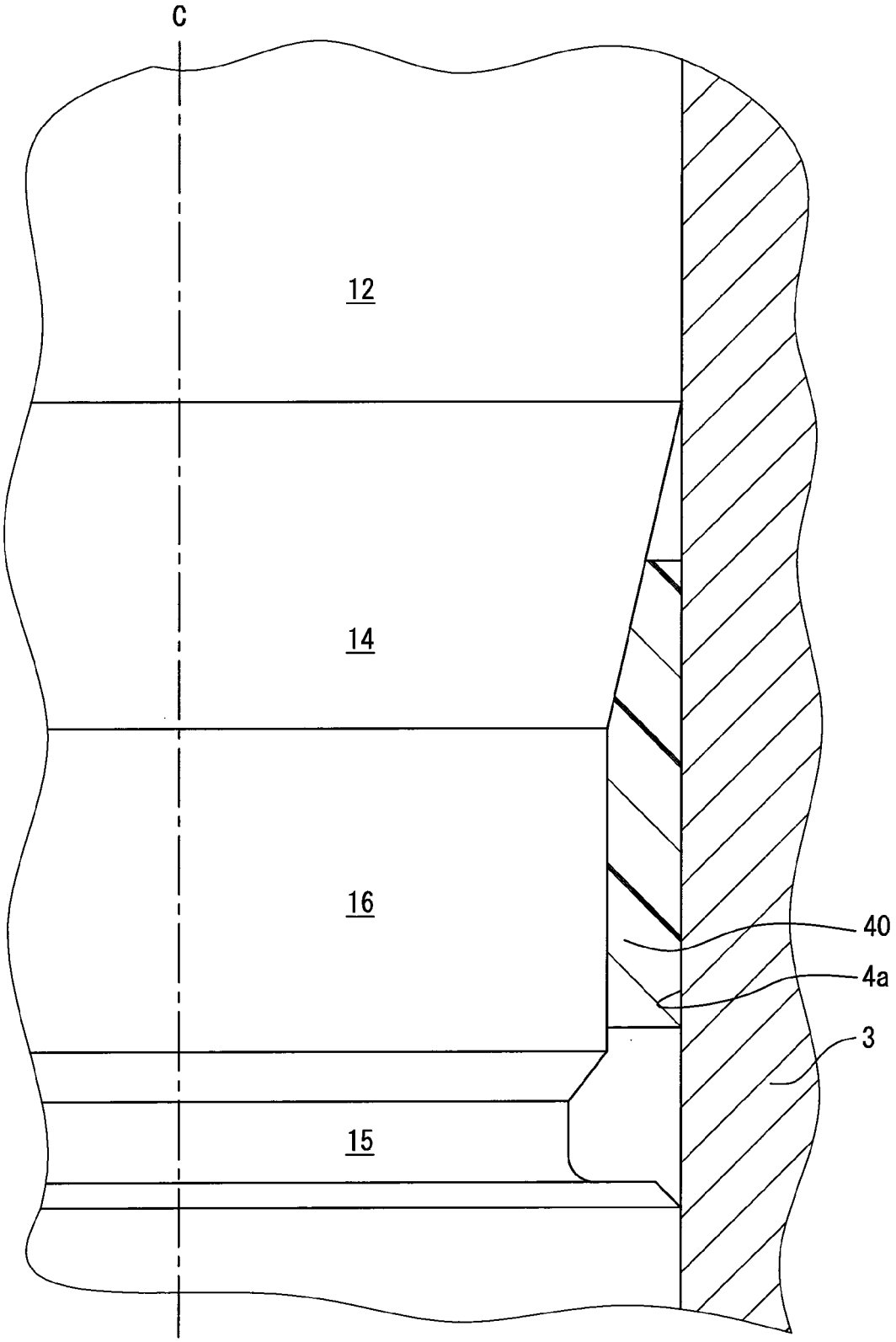
FIG. 11 is a diagram illustrating an ordinary use state after gas pressure is applied to a seal material in a fuel injection valve in accordance with a third embodiment.

In the present embodiment illustrated in FIG. 11, the second tapered part 18 and the parallel part 17 of the above first embodiment are eliminated. Specifically, a first tapered part 14 and a basal part 12 are formed in this order at a part of a body 10 that is continuous from a first reduced diameter part 16 on its opposite side from a nozzle hole 10*a*. The first tapered part 14 is located between the first reduced diameter part 16 and the basal part 12 to be connected continuously therebetween.

By this configuration with the elimination of the second tapered part 18 and the parallel part 17, the evacuation chamber 4*b* does not exist. Accordingly, although the effect of giving a longer life to a seal capacity is not produced, the process for performing the cutting work on the second tapered part 18 and the parallel part 17 is made unnecessary. Thus, man-hours taken to form the body 10 can be reduced.

(Fourth Embodiment)

In the above first embodiment, in the initial state at the point of completion of the insertion process, the end part 41 of the seal material 40 remains fitted in the groove portion 15. On the other hand, in the present embodiment, a state where an end part 41 is fitted in a groove portion 15 is maintained in the middle of the insertion process. However, in the initial state at the point of completion of the insertion process, the end part 41 is disengaged from the groove portion 15.

Timing at which the end part 41 is disengaged from the groove portion 15 may be as late as possible. For example, in making the end part 41 disengaged when the rest of the insertion amount has reached a predetermined amount, this predetermined amount may be set to be smaller than an axial length of a first tapered part 14.

In order that the end part 41 can be disengaged from the groove portion 15 in the middle of the insertion process in this manner, mainly, surface roughness of a first reduced diameter part 16, surface roughness of the groove portion 15, surface roughness of a seal material 40, a taper angle of a nozzle-hole opposite side wall surface 15*c*, or an elastic modulus and an elastic deformation amount of the seal material 40, for example, may be adjusted for the realization.

Summing up, in the present embodiment, in the initial state where a gas pressure that is a predetermined pressure or higher is not yet applied to the seal material 40 after the insertion of a body 10 into an attachment hole 4 has been completed, the end part 41 is removed from the groove portion 15. Accordingly, by a part of the body 10 on the opposite side of the groove portion 15 from a nozzle hole 10*a* (e.g., the first reduced diameter part 16 or the first tapered part 14), the seal material 40 is compressively-deformed in the radial direction to seal the clearance.

Thus, the seal material 40 is caught in the groove portion 15 until halfway through the insertion process. Consequently, the seal material 40 can be restricted from being pulled up by the friction similar to the effect of the first embodiment. Furthermore, since the seal material 40 is removed from the groove portion 15 at the point of completion of the insertion, a part of the seal material 40, to which the gas pressure is applied at the time of the first-time application of gas pressure to the seal material 40, can be only an end surface 41*a* of the seal material 40. As a consequence, the area of the seal material 40 that receives the gas pressure can be made smaller than in the case of the first embodiment (see FIG. 5) in which the first-time gas pressure is applied also to an inside corner 41*b* and an outside corner 41*c* of the seal end part 41 in addition to the end surface 41*a*. Therefore, because the amount of heat to which the seal material 40 is exposed by the gas in a combustion chamber 2 can be made small, a concern about the erosion of the seal material 40 can be alleviated.

(Fifth Embodiment)

In the above first embodiment, the seal material 40 has a uniformly-thick shape in a state where the seal material 40 is attached to the first reduced diameter part 16 and in a state prior to the insertion of the body 10 into the attachment hole 4. On the other hand, in the present embodiment, a seal material 40 having uneven thickness is employed, such that a thickness of a part of the seal material 40 that is fitted into a groove portion 15 is larger than that of the other part of the seal material 40. Specifically, an end part 41 of the seal material 40 is formed to have a large thickness in a direction in which the end part 41 enlarges radially inward of a main body part 42.

Accordingly, the need for the modification in the second attachment process S20 in FIG. 3 is eliminated, and the fitting of the end of the seal material 40 into the groove portion 15 in a state prior to the insertion is made realizable. Thus, in the present embodiment as well, a similar effect to the above first embodiment is produced.

The present disclosure is not limited to the description of the above embodiments, and may be embodied through the following modifications. Moreover, characteristic configurations of the embodiments may be respectively arbitrarily combined together. Modifications of the above embodiments will be described below.

The first reduced diameter part 16 may be connected continuously with a part of the body 10 on the opposite side of the nozzle hole part 11 from the nozzle hole 10*a* by eliminating the groove portion 15 of the above first embodiment. In this case, the seal material 40 is more easily displaced at the time of insertion of the body 10 than in the case of the body 10 including the groove portion 15. Nevertheless, because the taper angle θ1 of the first tapered part 14 is set at 10 degrees or larger, the above displacement is curbed.

In the above first embodiment, the first reduced diameter part 16 and the first tapered part 14 are formed to have the same surface roughness. Alternatively, the surface roughness of the first tapered part 14 may be formed to be smaller than the surface roughness of the first reduced diameter part 16. Accordingly, the close attachment between the first tapered part 14 and the seal material 40 is increased to improve the sealing properties between the seal material 40 and the first tapered part 14. As a result, the taper angle θ1 can be set at a large angle within a range of 10 degrees to 20 degrees, and the reduction in displacement of the seal material 40 at the time of insertion of the body 10 can be promoted.

In the above first embodiment, the taper angle θ2 of the second tapered part 18 is set in a range from 10 degrees to 20 degrees. Alternatively, the taper angle θ2 may be set at an angle out of this range. In this case, the parallel part 17 may be eliminated, and the second reduced diameter part may be constituted of the second tapered part 18.

In the above first embodiment, the surface roughness of the first tapered part 14 is set to be smaller than the surface roughness of the outer peripheral surface of the part 13 of the body 10 that accommodates the electric actuator 30. Alternatively, the surface roughnesses of this accommodating part 13 and the first tapered part 14 may be set at the same value.

The shape of the seal material 40 of the above first embodiment and the shape of the seal material of the above fifth embodiment may be combined together. Specifically, the seal material having uneven thickness, with its part that is fitted into the groove portion 15 having large thickness, is employed, and this part that is fitted into the groove portion 15 is modified to have a shape having a reducing diameter.

In the above first embodiment, the wall surface 15*c* of the groove portion 15 on its opposite side from the nozzle hole 10*a* is formed into a tapered shape whose diameter size of the body 10 increases gradually toward the opposite side from the nozzle hole 10*a*. Alternatively, this wall surface 15*c* may be formed into a curved shape.

The fuel injection valve 1 of the above first embodiment is attached to the cylinder head 3 as illustrated in FIG. 1. Alternatively, the fuel injection valve 1 may be a fuel injection valve attached to a cylinder block. In the above first embodiment, the fuel injection valve 1 disposed in the ignition-type internal combustion engine (gasoline engine)

has been described. Alternatively, the fuel injection valve 1 may be a fuel injection valve disposed in a compression self-ignition type internal combustion engine (diesel engine). In addition, in the above embodiments, the fuel injection valve that injects fuel directly into the combustion chamber 2 has been described. Alternatively, the fuel injection valve 1 may be a fuel injection valve that injects fuel into an intake pipe.

To sum up, the fuel injection valve 1 of the above embodiments can be described as follows.

A fuel injection valve 1 is adapted to be attached to an internal combustion engine and to have an annular seal material 40 attached thereon. The fuel injection valve 1 includes a body 10, a first reduced diameter part 16, and a first tapered part 14. The body 10 includes a nozzle hole 10*a* through which fuel is injected. The first reduced diameter part 16 is formed on an outer peripheral surface of the body 10 to have a shape obtained by radially reducing the body 10. The seal material 40 is attached to the first reduced diameter part 16. The first tapered part 14 is formed on the outer peripheral surface of the body 10 on an opposite side of the first reduced diameter part 16 from the nozzle hole 10*a*. The first tapered part 14 has its diameter size of the body 10 increased gradually toward the opposite side from the nozzle hole 10*a*. In a use state where the body 10 is inserted in an attachment hole 4 formed at a predetermined position of the engine and a gas pressure that is equal to or higher than a predetermined pressure is applied to the seal material 40 from its nozzle hole 10*a*-side, the seal material 40 is pressed against the first tapered part 14 by the gas pressure to be compressively-deformed, and a clearance between an inner peripheral surface 4*a* of the attachment hole 4 and the outer peripheral surface of the body 10 is sealed with a compressively-deformed part of the seal material 40. A taper angle θ1 of the first tapered part 14 is set in a range from 10 degrees to 20 degrees.

Accordingly, the seal material 40 is attached to the first reduced diameter part 16, and the first tapered part 14 is formed on the opposite side of the first reduced diameter part 16 of the body 10 from the nozzle hole 10*a*. As a result, the improvement in sealing properties by the above wedge effect is achieved. As a consequence of implementation of the test to vary the taper angle θ1 of this first tapered part 14 by the inventors, the following finding is obtained. Specifically, the test result in FIG. 8 indicates that at the taper angle of 10 degrees or larger, the displacement of the seal material 40 caused at the time of insertion of the body 10 into the attachment hole 4 can be limited to the extent that the seal material 40 is not damaged. The test result in FIG. 9 indicates that at the taper angle of 20 degrees or smaller, the sealing properties by the wedge effect can be sufficiently achieved.

In view of these test results, in the above embodiments, the taper angle θ1 of this first tapered part 14 is set at a range from 10 degrees to 20 degrees. Accordingly, there can be realized a compatibility between the limitation of the displacement of the seal material 40 caused at the time of insertion of the body 10 into the attachment hole 4 to limit the damage to the seal material 40, and the improvement in sealing properties by the wedge effect.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. A fuel injection valve adapted to be attached to an internal combustion engine and to have an annular seal material attached thereon, the fuel injection valve comprising:

a body that includes a nozzle hole through which fuel is injected;

a first reduced diameter part that is formed on an outer peripheral surface of the body to have a shape obtained by radially reducing the body, wherein the seal material is attached to the first reduced diameter part;

a first tapered part that is formed on the outer peripheral surface of the body on an opposite side of the first reduced diameter part from the nozzle hole;

a second reduced diameter part that has a shape obtained by radially reducing the body at a part of the outer peripheral surface of the body that is continuous with the first tapered part on its opposite side from the nozzle hole, wherein the second reduced diameter part is formed such that a clearance is defined between the second reduced diameter part and an inner peripheral surface of an attachment hole; and an annular groove portion that is recessed in a radial direction of the body, wherein:

the groove portion is formed only at a part of the first reduced diameter part to which an end part of the seal material on the nozzle hole-side is attached;

the first tapered part has its diameter size of the body increased gradually toward the opposite side from the nozzle hole;

in a use state where the body is inserted in the attachment hole formed at a predetermined position of the engine and a gas pressure that is equal to or higher than a predetermined pressure is applied to the seal material from its nozzle hole-side, the seal material is pressed against the first tapered part by the gas pressure to be compressively-deformed, and a clearance between an inner peripheral surface of the attachment hole and the outer peripheral surface of the body is sealed with a compressively-deformed part of the seal material;

a taper angle of the first tapered part is set in a range from 10 degrees to 20 degrees;

the first reduced diameter part, to which the seal material is attached, is not formed in a tapered shape;

a part of the body that is continuous from the second reduced diameter part to its opposite side from the nozzle hole includes a basal part;

the basal part of the body is inserted in the attachment hole;

the first tapered part and a part of the body that is continuous with the first tapered part on its opposite side from the nozzle hole are smoothly connected together and are not connected perpendicularly.

2. The fuel injection valve according to claim 1, wherein the second reduced diameter part includes a parallel part at which the diameter size of the body is the same in an axial direction of the body.

3. The fuel injection valve according to claim 2, wherein:

the second reduced diameter part includes a second tapered part that has its diameter size of the body increased gradually toward the opposite side from the nozzle hole; and the parallel part is located between the first tapered part and the second tapered part.

4. The fuel injection valve according to claim 3, wherein a taper angle of the second tapered part is set in a range from 10 degrees to 20 degree.

5. The fuel injection valve according to claim 1, further comprising a valving element that opens or closes the nozzle hole, and an electric actuator that generates magnetic attraction force to make the valving element open or close the nozzle hole, wherein:

the valving element and the electric actuator are accommodated in the body; and a surface roughness of the first tapered part is smaller than a surface roughness of an outer peripheral surface of a part of the body that accommodates the electric actuator.

6. The fuel injection valve according to claim 1, further comprising the seal material that is attached to the first reduced diameter part such that the end part of the seal material is fitted in the groove portion, wherein the end part has a cylindrical shape whose outer diameter size is reduced gradually toward the nozzle hole.

7. The fuel injection valve according to claim 1, wherein an entire end surface of the end part of the seal material on the nozzle hole-side is located in the groove portion.

8. The fuel injection valve according to claim 1, wherein a wall surface of the groove portion on the opposite side from the nozzle hole is formed in a tapered shape that has its diameter size of the body increased gradually toward the opposite side from the nozzle hole.

9. The fuel injection valve according to claim 1, wherein in an initial state where the gas pressure that is equal to or higher than the predetermined pressure is not yet applied to the seal material after the insertion of the body into the attachment hole has been completed, the seal material is clamped between a wall surface of the groove portion on the opposite side from the nozzle hole and an inner peripheral surface of the attachment hole to be compressively-deformed, and the clearance between the inner peripheral surface of the attachment hole and the outer peripheral surface of the body is sealed with a compressively-deformed part of the seal material.

10. The fuel injection valve according to claim 1, wherein in an initial state where the gas pressure that is equal to or higher than the predetermined pressure is not yet applied to the seal material after the insertion of the body into the attachment hole has been completed, the end part of the seal material is disengaged from the groove portion, the seal material is clamped between a part of the first reduced diameter part on an opposite side of the groove portion from the nozzle hole and an inner peripheral surface of the attachment hole to be compressively-deformed, and the clearance between the inner peripheral surface of the attachment hole and the outer peripheral surface of the body is sealed with a compressively-deformed part of the seal material.

11. The fuel injection valve according to claim 1, wherein in a state where the body is not inserted in the attachment hole, an outermost circumferential position of the seal material, with the seal material attached to the first reduced diameter part, is located radially outward of an outermost circumferential position of a nozzle hole-side wall surface of the groove portion.

12. The fuel injection valve according to claim 1, wherein in a state where the body is not inserted in the attachment hole, an outermost diameter size of the seal material is set to be larger than an inner diameter size of the inner peripheral surface of the attachment hole.

* * * * *